United States Patent [19]

Balderson

[11] Patent Number: 4,763,099

[45] Date of Patent: Aug. 9, 1988

[54] TEMPERATURE SENSITIVE DEVICE

[75] Inventor: Simon N. Balderson, Reading, England

[73] Assignee: Thorn EMI plc, London, England

[21] Appl. No.: 937,486

[22] Filed: Dec. 3, 1986

[30] Foreign Application Priority Data

Dec. 4, 1985 [GB] United Kingdom ..... 8529867

[51] Int. Cl.[4] ..... H01C 3/04

[52] U.S. Cl. ..... 338/22 R; 338/306

[58] Field of Search ..... 338/22 R, 22 SD, 25, 338/23, 24, 215, 306, 308; 428/413, 432, 201, 214; 427/98, 101, 304, 383.7

[56] References Cited

U.S. PATENT DOCUMENTS 4,380,749 4/1983 Eichelberger et al. ..... 338/215
4,603,008 7/1986 Tosaki et al. ..... 338/22 R
4,642,136 2/1987 Furushima et al. ..... 338/22 R

FOREIGN PATENT DOCUMENTS 0079586 5/1983 European Pat. Off. .
1116352 6/1968 United Kingdom .
1136198 12/1968 United Kingdom .
1224422 3/1971 United Kingdom .
1243410 8/1971 United Kingdom .

*Primary Examiner*—E. A. Goldberg
*Assistant Examiner*—M. M. Lateef
*Attorney, Agent, or Firm*—Fleit, Jacobson, Cohn & Price

[57] ABSTRACT

A heater comprises a substrate having an electrically-insulative ceramic coating and a heater track deposited on the coating and electrically connected to a power supply via ends. The heater track consists of a composite material having predetermined proportions of a metal and a material capable of undergoing a reversible change in volume at a predetermined phase transition temperature. The change in volume changes the proportions of metal to material and thus changes the resistivity of the composite material, so that the heater can be used as a self-regulating thermal cut-out device by limiting its own heat output to the phase transition temperature.

6 Claims, 2 Drawing Sheets

TEMPERATURE SENSITIVE DEVICE

This invention relates to a temperature sensitive device and in particular, though not exclusively, to such a device for controlling the power supplied to a load, for example a resistive heater, in accordance with a predetermined threshold temperature.

Known temperature sensitive devices of this type generally consist of a thermostat or a thermal cut-out device, which disconnects, or at least reduces, the power supplied to the heater when a predetermined threshold temperature is sensed and reconnects, or increases, the supplied power when the temperature falls below the threshold temperature.

Such devices may consist of a mechanical switch including a thermally-expansive member, such as a metal rod or a bimetallic strip, which undergoes thermal expansion, when heated, and operates a switch at the threshold temperature.

Alternatively, such devices may consist of a temperature-dependent resistor, the output of which is compared with a reference signal indicative of the threshold temperature.

However, these conventional temperature-sensitive devices have relatively complex constructions and thus tend to be susceptible to malfunction during operation, particularly mechanical devices including moving components.

As an alternative to such mechanical devices, U.K. Pat. No. 1,243,410 discloses the use of vanadium dioxide, which exhibits an abrupt change in electrical conductivity at a predetermined transition temperature and can thus be employed as both heater and temperature regulator.

However, vanadium dioxide can only be used as a thermal cut-out at one particular temperature, i.e. at its transition temperature, and even when the material is suitably doped, as described in U.K. Pat. No. 1,243,410, the range of temperatures within which the doped material can be made to exhibit a phase transition may be relatively limited.

It is therefore an object of the present invention to provide a temperature-sensitive device, which, on the one hand, is more reliable than known mechanical temperature-sensitive devices, and, on the other hand, can be made to operate at a temperature selected from a relatively wide range of temperatures.

According to the present invention there is provide a temperature-sensitive device comprising an electrically-conductive composite material consisting of predetermined proportions of a metal and a material capable of undergoing a reversible phase transition at a predetermined temperature, said phase transition consisting of a reversible change in volume of said phase transition material, thereby effecting a reversible change in said proportions and thus in said electrical conductivity of said composite material at said temperature.

In one embodiment, the composite material is deposited on a substrate in the form of a heater track, the heat output of which is reduced by a decrease in the electrical conductivity when the temperature, at which the phase transition occurs, is reached. When the temperature subsequently falls below the phase transition temperature, the phase transition material undergoes a reverse phase transition so that the electrical conductivity, and thus the heat output, of the heater is returned to its original value.

In this manner, the heater is effectively a self-regulating device, which limits its own heat output to a predetermined threshold temperature.

The material capable of undergoing the reversible phase transition may be one of a number of suitable materials, such as a ceramic or a polymer, which materials undergo the phase transition over a wide range of temperatures.

The invention will now be further described by way of example only with reference to the accompanying drawings, wherein.

Figure 1:
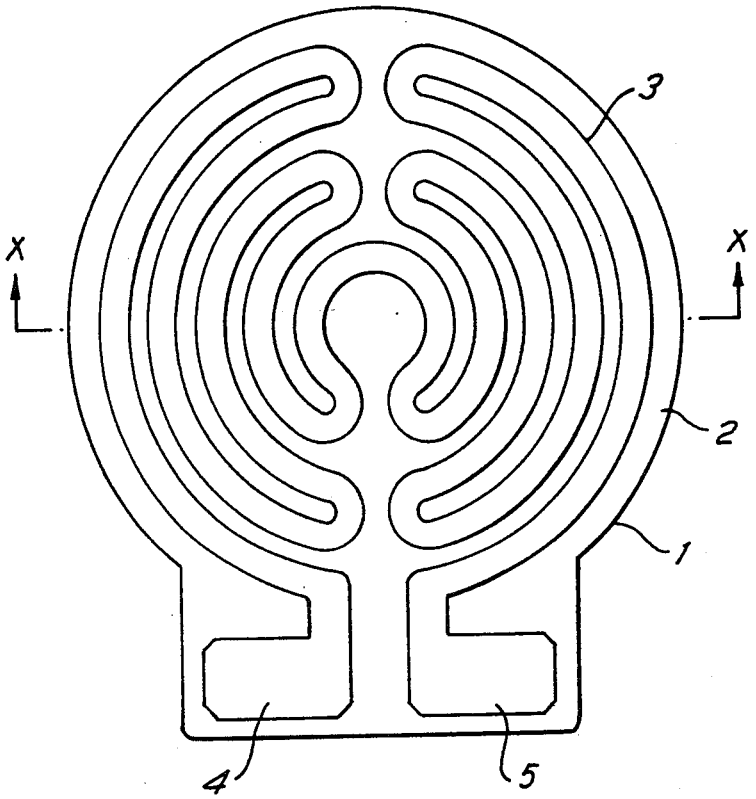
FIG. 1 shows one embodiment of the present invention.
Figure 2:
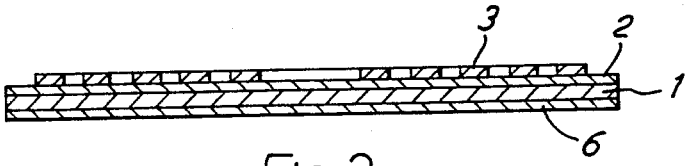
FIG. 2 shows a section through X—X in FIG. 1.

A heater, shown in FIGS. 1 and 2, comprises a substrate 1, preferably formed from a metal, having an electrically-insulative ceramic coating 2 on one side thereof. A heater track 3, preferably in the form of a thick film ink, is deposited, such as by any suitable printing technique, onto the coating 2 and is electrically connected to a power supply via ends 4 and 5. A coating 6, of similar or the same composition as coating 2, may also be provided on the side of the substrate 1 remote from the heater track 3.

The heater track 3 is formed from a composite material consisting of predetermined proportions of a suitable ceramic material and a metal, preferably in the form of a powder.

Figure 3:
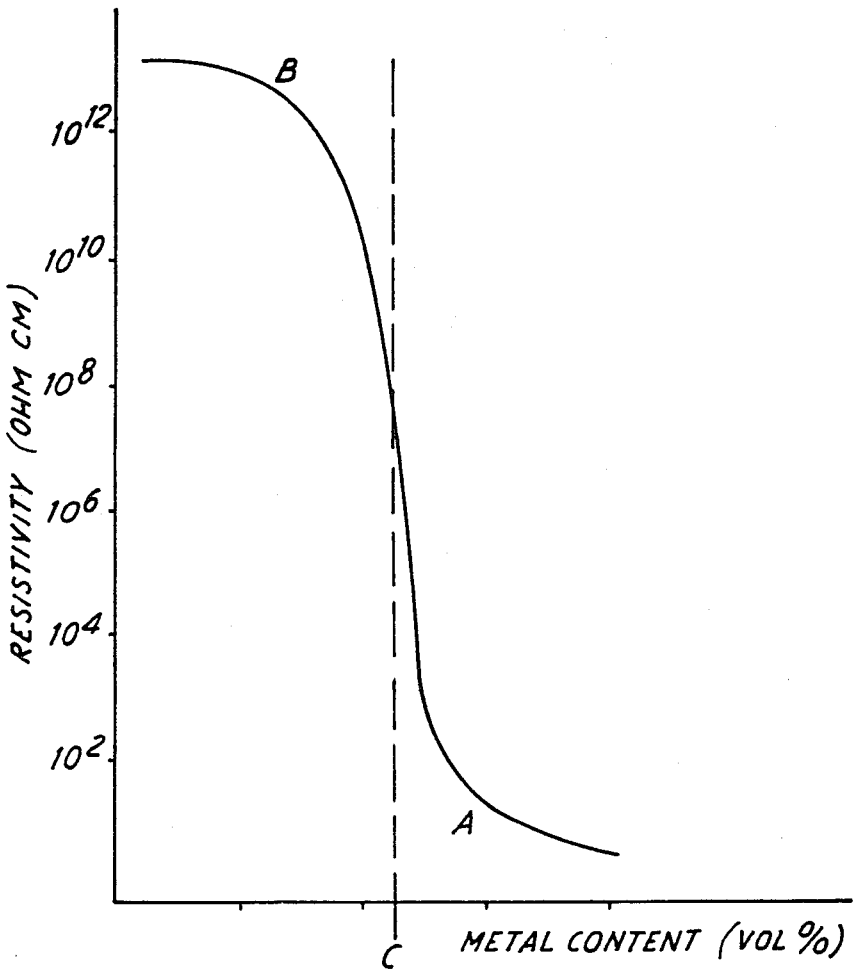
FIG. 3 shows a typical graph of resistivity versus percentage by volume of metal content of a metal-ceramic composite material utilised in the present invention.

As shown by the graph in FIG. 3, when a metal is added to an electrically-insulative ceramic material, the electrical resistivity, and thus conductivity, of the composite material varies, in dependence on the relative proportions by volume of the metal and the ceramic material.

It can be seen from FIG. 3 that, as the metal content is increased, at a critical metal content C by volume, a sudden decrease in resistivity, and thus a corresponding increase in conductivity, of the composite material occurs, because at this point a complete network of interconnecting metal particles exists throughout the material, thereby making it a good electrical conductor.

The ceramic material for the composite material is specifically chosen such that it undergoes a reversible phase transition, when heated to a particular temperature, which causes a change in volume of the ceramic material.

When, therefore, a composite of the selected ceramic and metal, mixed in predetermined proportions by volume at room temperature so that the composite is a relatively good electrical conductor, is heated to the phase transition temperature, the ceramic expands, thereby causing an effective decrease in the volume proportion of metal content. The proportions of ceramic and metal at room temperature are determined to ensure that the expansion of the ceramic, when heated to the phase transition temperature, causes the proportion of metal content to decrease to below the critical content C, thereby effecting a sudden increase in resistivity, and thus a corresponding decrease in conductivity, of the composite at this temperature.

The value of the critical metal content C is generally between 30% and 40% by volume, but this concentration can vary considerably, in dependence on the particle size and shape before preparation of the composite material. In fact, the composite material may be made electrically conductive with a much lower metal content, particularly if a fibrous metal material is used.

By utilising a composite material of this type for the material of the heater track 3, a voltage can be applied to the heater until it reaches the phase transition temperature, at which the ceramic expands, effectively reducing the volume proportion of metal content to below the critical value C and thus causing a sudden decrease in electrical conductivity of the heater track 3. At this point therefore, the heat output of the heater track 3 is significantly reduced and it begins to cool. As it cools to below the phase transition temperature, a reverse phase transition occurs and the ceramic returns to its original volume, effectively increasing again the proportions of the metal content to its original value above the critical value and thus causing a sudden return of the electrical conductivity to its original relatively high value.

In this manner, the heater is caused to be temperature-sensitive and becomes a self-regulating thermal cut-out device by limiting its own heat output to the phase transition temperature of the ceramic of the composite material.

A considerable number of ceramic and other types of materials undergo a change in volume at different phase transition temperatures, so that a suitable material can be selected to provide the correct threshold temperature for a particular application for the thermal cut-out device.

A specific example of a suitable ceramic material is quartz, which has a phase transition temperature of approximately 573° C., at which a significant change in volume of the material occurs. Any suitable metal, which is stable to at least the phase transition temperature of the ceramic, may be utilised. Such a heater track, formed from a composite of quartz and a suitable metal to provide a thermal cut-out, may have applications, for example, in glass ceramic cooking hobs (not shown), wherein it is necessary to limit the operating temperature to prevent overheating of the glass ceramic cooktop.

Other suitable materials include polymers, which undergo a phase transition known as the "Glass Transition" between a crystalline and an amorphous state, accompanied by a change in volume. The polymer materials can be loaded with a conductive metal filler to the critical concentration referred to hereinbefore and a change in resistivity of the polymer-metal composite material is exhibited at the glass transition temperature, when the polymer undergoes a significant change in volume.

Four specific examples of suitable polymers and their approximate transition temperatures are shown below.

| Polymer | Transition Temp. (°C.) |
|---|---|
| Polystyrene | 100 |
| Polybutadiene | 200 |
| Nylon-66 | 322 |
| Polyethylene terephthalate | 342 |

The transition temperatures of polymers have been found to be particularly sensitive to molecular weight changes, so that the transition temperature can be readily changed by variation in the molecular weight, thereby increasing further the temperature range over which devices, in accordance with the invention, can be made to operate.

Some polymers, such as polybutadiene, may undergo a substantially continuous change in volume with temperature rather than an abrupt change, but still exhibit a discontinuity in the rate of volume change at the transition temperature. After this temperature, there is a marked increase in the rate of change of volume, thereby resulting in a higher resistivity increase with temperature in the polymer-metal composite material.

Rather than using the composite material as a self-regulating heater, it may be used merely as a temperature-sensitive device, which forms an electrical connection to a separate heater, or other load, the heat output of which is required to be limited to the threshold phase transition temperature of the ceramic of the composite material. As the load heats the composite material to the threshold temperature, expansion of the ceramic significantly reduces electrical conduction through the material, thereby reducing electrical connection of the load to the voltage supply. As the heat output of the load decreases to below the threshold temperature, the electrical connection is restored.

A temperature-sensitive device, in accordance with the present invention, may be utilised in many other temperature-sensing applications including non-destructable fuses, thermostats and other safety cut-outs and sensors.

If temperature regulation below the threshold temperature is required, such as in a cooking hob, an additional temperature sensor, which responds continuously to change in temperature would be needed.

The present temperature-sensitive device is therefore much simpler in construction than known thermal cut-outs and other temperature sensors, as well as being more reliable in operation, because it has no moving parts, which may be susceptible to malfunction.

What is claimed is:

1. A temperature-sensitive device comprising an electrically-conductive composite material consisting of, in predetermined proportions, a metal and an electrically non-conductive material which has the characteristic of undergoing a reversible phase transition at a predetermined temperature, said phase transition consisting of a reversible change in volume of said phase transition material, thereby effecting a reversible change in said proportions by volume of the said composite material and thus in said electrical conductivity of said composite material at said temperature.

2. A device as claimed in claim 1 wherein said composite material is deposited on an electrically-insulative substrate in the form of a heater track, the heat output of which is changed by said reversible change in said electrical conductivity.

3. A device as claimed in claim 2 wherein said composite material is deposited onto said substrate by a printing technique.

4. A device as claimed in claim 1 wherein said composite material is formed into a thick film ink.

5. A device as claimed in claim 1 wherein said material capable of undergoing said reversible phase transition is a ceramic material.

6. A device as claimed in claim 1 wherein said material capable of undergoing said reversible phase transition is a polymer material.

* * * * *

REEXAMINATION CERTIFICATE (1539th)

United States Patent [19]

Balderson

[11] B1 4,763,099

[45] Certificate Issued Aug. 27, 1991

[54] TEMPERATURE SENSITIVE DEVICE

[75] Inventor: Simon N. Balderson, Reading, England

[73] Assignee: Thorn EMI plc, London, United Kingdom

Reexamination Request:
No. 90/002,096, Jul. 27, 1990

Reexamination Certificate for:

| | |
|---|---|
| Patent No.: | **4,763,099** |
| Issued: | **Aug. 9, 1988** |
| Appl. No.: | **937,486** |
| Filed: | **Dec. 3, 1986** |

[30] Foreign Application Priority Data

Dec. 4, 1985 [GB] United Kingdom ..... 8529867

[51] Int. Cl.[5] ..... H01C 7/02; H01C 7/04; H01C 7/13; H01C 7/22

[52] U.S. Cl. ..... 338/22 R; 219/505; 338/306

[58] Field of Search ..... 338/22 R, 22 SD, 23, 338/24, 31, 215, 306, 308; 219/494, 504, 505, 543, 553; 252/511-515; 427/98, 101, 304; 428/201, 413, 432

[56] References Cited

U.S. PATENT DOCUMENTS

| | | | |
|---|---|---|---|
| 2,375,178 | 5/1945 | Ruben | 29/621 |
| 2,386,095 | 10/1945 | Edgar et al. | 252/511 X |
| 2,744,981 | 5/1956 | Spears | 338/114 |
| 2,978,665 | 4/1961 | Vernet et al. | 252/511 X |
| 3,243,753 | 3/1966 | Kohler | 338/31 |
| 3,673,121 | 6/1972 | Meyer | 252/511 |
| 4,149,066 | 4/1979 | Niibe | 219/505 |
| 4,545,926 | 10/1985 | Fouts, Jr. et al. | 252/511 |
| 4,560,498 | 12/1985 | Horsma et al. | 252/511 |
| 4,629,869 | 12/1986 | Bronnvall | 219/505 X |
| 4,654,511 | 3/1987 | Horsma et al. | 338/22 R X |
| 4,722,853 | 2/1988 | Batliwalla et al. | 252/511 X |

FOREIGN PATENT DOCUMENTS 1338953 11/1973 United Kingdom .

*Primary Examiner*—Marvin M. Lateef

[57] ABSTRACT

A heater comprises a substrate having an electrically-insulative ceramic coating and a heater track deposited on the coating and electrically connected to a power supply via ends. The heater track consists of a composite material having predetermined proportions of a metal and a material capable of undergoing a reversible change in volume at a predetermined phase transition temperature. The change in volume changes the proportions of metal to material and thus changes the resistivity of the composite material, so that the heater can be used as a self-regulating thermal cut-out device by limiting its own heat output to the phase transition temperature.

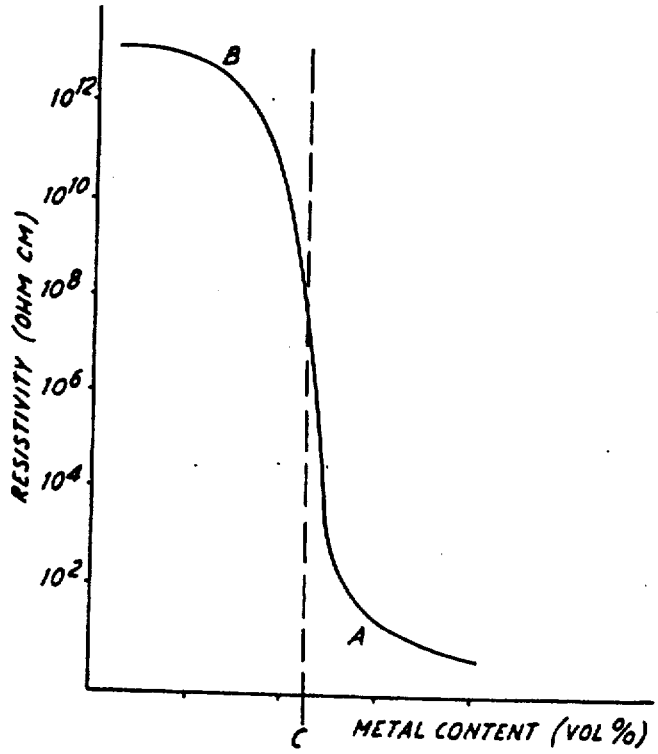

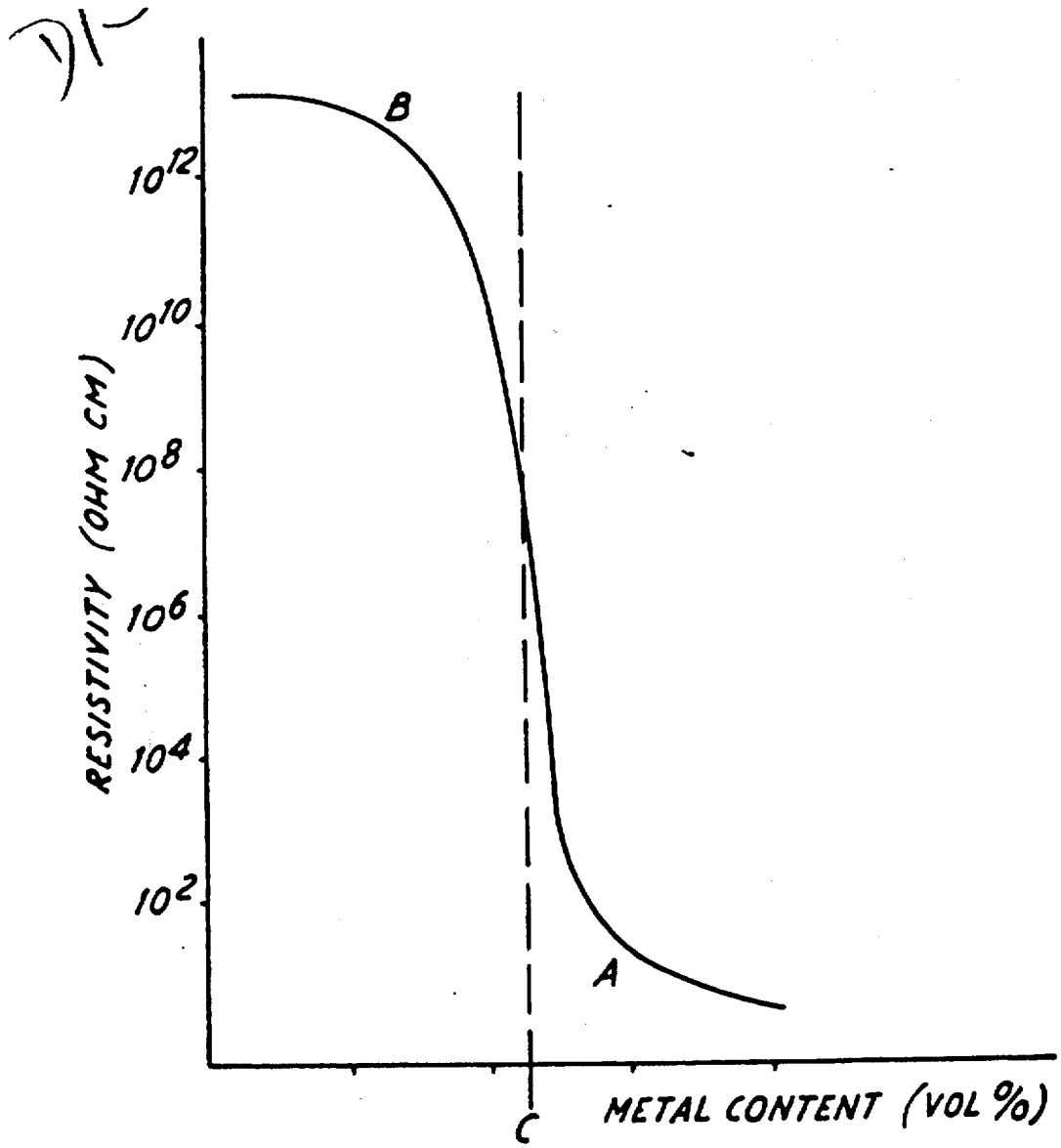
B
A
$10^{12}$
$10^{10}$
$10^{8}$
$10^{6}$
$10^{4}$
$10^{2}$
RESISTIVITY (OHM CM)
C
METAL CONTENT (VOL %)

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, between lines 42 and 43:

*U.K Patent No. 1,338,953 discloses a polymeric element comprising a crystalline polymer of relatively narrow molecular weight distribution together with a filler including conductive particles. However, the temperature range over which this element exhibits a sharp increase in resistance (positive temperature coefficient) is also limited, and there is no suggestion that this material would be useful in the application of the present invention, i.e., as a thick-film heater track.*

Column 1, lines 49–68:

According to the present invention there is provided a temperature-sensitive device comprising an electrically-conductive composite material *deposited on an electrically insulative substrate in the form of a thick film heater track producing a heat output when connected to an electric power supply, said composite material* consisting of, *in* predetermined proportions, *a metal and* [a] *an electrically non-conductive* material [capable] *which has the characteristic* of undergoing a reversible phase transition at a predetermined temperature, said phase transition consisting of a reversible change in volume of said phase transition material, thereby effecting a reversible change in said proportions *by volume of said composite material* and thus in said electrical conductivity of said composite material *and the heat output of the heater track* at said temperature.

[In one embodiment, the composite material is deposited on a substrate in the form of a heater track, the heat output of which is reduced by a decrease in the electrical conductivity when the temperature, at which the phase transition occurs, is reached.]

When the temperature subsequently falls below the phase transition temperature, the phase transition material undergoes a reverse phase transition so that the electrical conductivity, and thus the heat output, of the heater is returned to its original value.

AS A RESULT OF REEXAMINATION, IT HAS BEEN DETERMINED THAT:

Claim 2 is cancelled.

Claims 1 and 3 are determined to be patentable as amended.

Claims 4, 5 and 6, dependent on an amended claim are determined to be patentable.

New claims 7–16 are added and determined to be patentable.

1. A temperature-sensitive device comprising an electrically-conductive composite material *deposited on an electrically insulative substrate in the form of a thick film heater track producing a heat output when connected to an electric power supply, said composite material* consisting of, in predetermined proportions, a *conductive* metal and an electrically non-conductive material which has the characteristic of undergoing a reversible phase transition at a predetermined temperature, said phase transition [consisting of] *including* a reversible change in volume of said phase transition material, thereby effecting a reversible change in said proportions by volume of said composite material and thus in said electrical conductivity of said composite material *and the heat output of the heater track* at said temperature.

3. A device as claimed in claim [2] *1* wherein said composite material is deposited onto said substrate by a printing technique.

*7. The device as claimed in claim 5, wherein said ceramic material is quartz.*

*8. The device as claimed in claim 6 wherein said polymer material is of a type in which said reversible phase transition change in volume is accompanied by a glass transition which is between a crystalline state and an amorphous state.*

*9. The devce as claimed in claim 8 wherein said polymer material is polystyrene.*

*10. The device as claimed in claim 9 wherein the polystyrene has a glass transition temperature on the order of 100° C.*

*11. The device as claimed in claim 8 wherein said polymer material is polybutadiene.*

*12. The device as claimed in claim 11 wherein the polybutadiene has a glass transition temperature on the order of 200° C.*

*13. The device as claimed in claim 8 wherein the polymer material is nylon-66.*

*14. The device as claimed in claim 13 wherein the nylon-66 has a glass transition temperature on the order of 322° C.*

*15. The device as claimed in claim 8 wherein the polymer material is polyethylene terephthalate.*

*16. The device as claimed in claim 15 wherein the polyethylene terephthalate has a glass transition temperature on the order of 342° C.*

* * * * *